United States Patent [19]

Rooney

[11] 4,282,619

[45] Aug. 11, 1981

[54] TRUSS STRUCTURE

[75] Inventor: Craig E. Rooney, Prairie Village, Kans.

[73] Assignee: Havens Steel Company, Kansas City, Mo.

[21] Appl. No.: 94,955

[22] Filed: Nov. 16, 1979

[51] Int. Cl.[3] ..... E01D 9/00; E04C 3/02

[52] U.S. Cl. ..... 14/6; 52/648; 52/693; 14/17; 14/73

[58] Field of Search ..... 14/6, 1, 73, 17, 74, 14/3; 52/693, 648

[56] References Cited

U.S. PATENT DOCUMENTS

| | | | |
|---|---|---|---|
| 33,629 | 11/1861 | Avery | 14/6 |
| 1,153,099 | 9/1915 | Moore | 14/3 |
| 2,860,743 | 11/1958 | Cliff | 52/693 X |
| 3,103,025 | 9/1963 | Gassner | 14/73 X |
| 3,181,187 | 5/1965 | Kahn | 14/73 |
| 3,906,571 | 9/1975 | Zetlin | 14/6 X |
| 4,129,917 | 12/1978 | Sivachenko | 14/6 X |
| 4,178,736 | 12/1979 | Salas | 52/693 X |

FOREIGN PATENT DOCUMENTS

| | | | |
|---|---|---|---|
| 846599 | 8/1960 | United Kingdom | 52/693 |

*Primary Examiner*—Nile C. Byers, Jr.
*Attorney, Agent, or Firm*—Schmidt, Johnson, Hovey &Williams

[57] ABSTRACT

A low cost, factory fabricated, force distributing bridge truss assembly is disclosed which includes respective, interconnected, converging pairs of carrier truss structures designed to be composited to an overlying concrete bridge deck such that the latter serves as a top chord diaphragm for absorbing live load-induced compression and bending forces. The carrier truss structures are fabricated using only two standard shapes of plasma arc cut steel angles (normally 6"×6" for truss webs and 8"×8" for truss chords) welded directly together without the need for special order steel or supplemental gusset plates. The preferred deck for use with the truss assembly hereof is a concrete structure having a lowermost, spanning metallic plate substrate composited (by means of upstanding studs) to a concrete layer thereon. This assembly may be applied to the carrier truss structure in either precast, sectionalized form or field cast in place. The upper chord elements of the respective carrier trusses are simply welded to the planar underlying substrate at the panel points to develop the final mechanical composite. Completed bridges using the carrier truss assemblies of the invention are characterized by very low depth-to-span and dead load/live load ratios, minimal deflections, and high degrees of structural redundancy rendering the bridges extremely stable; moreover they are protected against critical collapse and are highly suited for performance in situations where long term fatigue causing stress reversals are a problem.

13 Claims, 15 Drawing Figures

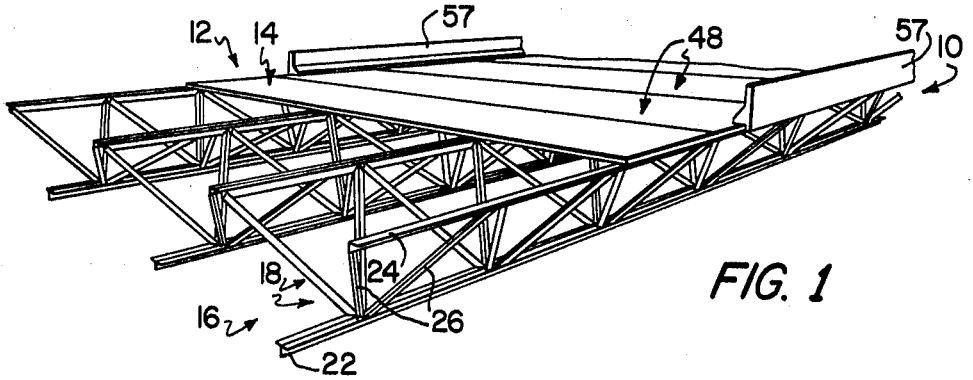
FIG. 1
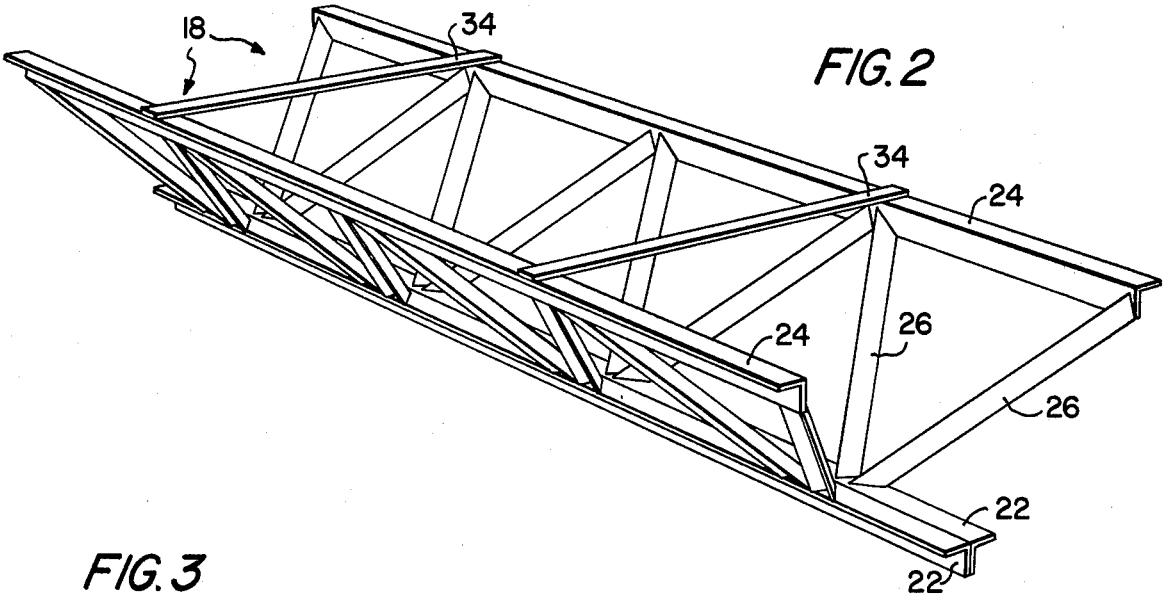
FIG. 2
FIG. 3
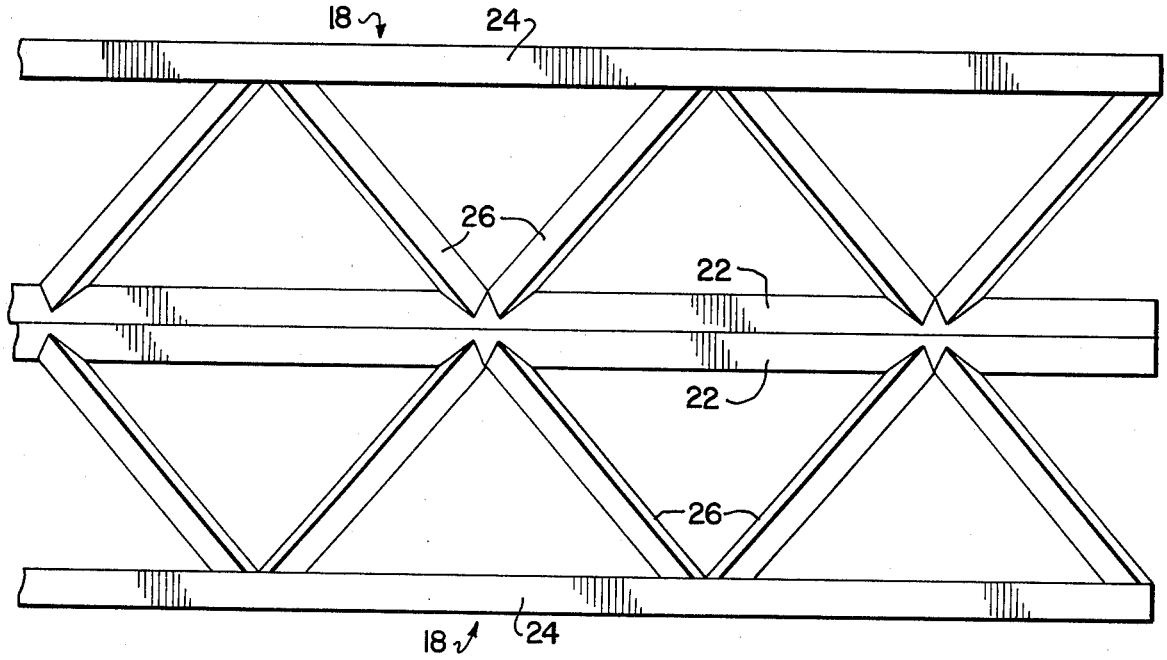

TRUSS STRUCTURE

BACKGROUND OF THE INVENTION

1. Field of the Invention

The present invention is concerned with low cost, structurally superior truss assemblies especially designed for use in constructing bridges of from 70 to 200 feet in length, although longer spans are also a possibility. More particularly, it is concerned with such improved truss assemblies wherein the concrete superstructure or deck of the bridge is mechanically composited to carrier truss frames of the overall assembly such that the deck serves as a top chord diaphragm for absorbing live load induced compression and bending forces for the truss framed structures; in this way maximum advantage is taken of the considerable compressive strength and inertial moment of concrete with the least possible dead load to the resultant structure. The assemblies hereof are particularly advantageous inasmuch as they can be factory produced using minimal quantities of structural steel, all of the steel being standard mill stock.

2. Description of the Prior Art

The construction of modern day bridges, such as highway and railroad bridges, is subject to a number of constraints, principally arising from the necessity of adequately distributing and safely absorbing concentrated moving loads imposed thereon without excessive deflection. In the case of highway bridges, the recognition of this problem has led to promulgation of a plethora of rather stringent regulations. For example, one commonly applied code specifies that the completed bridge must be able to sustain, over each possible ten foot travelway within its width, a uniform load of 640 lbs. per lineal foot, and 32,000 lbs. of moving and concentrated load. Additional provisions of the code deal with shear concentrations, and the effects of impact. The bridge must also exhibit sufficient stiffness to strictly limit deflections and oscillations, usually limited to a deflection-to-span ratio of 1 to 800 or less under full live loading with impact. A large number of other provisions also exist for ensuring structural stability due to wind, ice, braking impacts and centrifugal effects.

In addition to the foregoing, a bridge must have a relatively long useful life, require only a minimum of maintenance, and have the ability to withstand climatic freeze/thaw cycles and the effects of deicing compounds used for maintenance of the trafficway.

Thus, although it is entirely possible to demonstrate that a typical bar joist commonly used in building construction to support an office floor or roof can serve as a bridgeway for pedestrians or light vehicular traffic, such a construction is in no way related to the service loading or structural requirements of a modern-day highway bridge.

A number of bridge structures have been developed in the past in attempts to provide safe, stable, yet reasonably priced bridges. One such class of bridges heretofore known are so-called steel truss bridges. There are two basic types of steel truss bridges: (1) where the trussing is above the bridge deck, and the deck roughly conforms to the bottom chord plane of the truss structure; and (2) the underslung truss bridge where the bridge deck is supported by the top chords of the truss structure. Steel truss bridges are seldom used in current bridge construction except in the case of long river spans. This is because of the expense involved in the fabrication and erection of steel truss bridges, and a characteristic depth-to-span ratio of about 1:10 (in order to keep deflection within acceptable limits). Insofar as expense is concerned, for a span of 120–200 feet, the cost of a conventional steel truss bridge would probably be from 70 to 120 dollars per square foot, which is well above certain other types of bridge constructions. Further, the relatively deep trussing required in connection with underslung truss bridges creates problems when maximum clearance under the bridge is required for traffic or high water conditions.

One of the principal elements of cost in connection with known steel truss bridges stems from the fact that much of the truss assembly thereof must normally be constructed in the field using skilled on-site labor and expensive cranes and other equipment. Additionally, such trussing is normally specially designed, necessitates elaborate engineering, and requires large quantities of special order steel, all of which greatly add to the final cost. Finally, additional steel (and hence dead weight and fabrication costs) are normally required because of the need of expensive gusset plates and cross bracing between trusses at the panel points of the trusses.

SUMMARY OF THE INVENTION

The present invention is concerned with steel truss bridges having greatly improved structural characteristics while at the same time being relatively low in cost. Broadly speaking, bridges in accordance with the invention include an elongated, spanning deck including a concrete layer, and a metallic truss assembly beneath the deck and mechanically composited to the concrete deck layer such that the latter serves after the deck is in place as a top chord diaphragm for absorbing live load-induced compression and bending stresses. As used herein, a diaphragm refers to a generally planar structural element capable of, within its own internal structure, distributing tensile and/or compressive forces within and across the plane thereof to the diaphragm supports. In the instant proposed construction, the diaphragm supports are the panel points of the underlying carrier trusses. The assembly includes at least one truss structure having an elongated, metallic, tension force-absorbing lower chord lying in the direction of bridge span, with a plurality of upwardly extending metallic web members coupled to the lower chord.

Normally, a completed truss assembly will include respective pairs (e.g., three) of the elongated, generally planar truss structures disposed in juxtaposed, angular, converging orientation relative to one another, with the upper ends of the truss structures spaced apart in a direction transverse to the direction of span, and with the lower chords thereof being adjacent. Bolts or other means are provided for interconnecting the lower chords along the lengths thereof.

The trusses of the invention are preferably shop fabricated using only two sizes of one standard shape of steel angle. Thus, the lower chord and upper chord elements (which are ultimately composited with the bridge deck to form a complete upper chord) are formed from given steel angles whereas the angularly oriented web members interconnected between the chord and chord element are fabricated from another, smaller steel angle. The web members are advantageously cut using known plasma arc cutting techniques to lower costs, and are then placed between and in engagement with the upper and lower chord elements. The web members are then directly welded in place. This welding, due to the nature of the geometry of the resulting construction, and the method of face cutting (plasma arc) of the web angles, can be accomplished from one side only and fully develop each angle web without the need for additional gusset plates, normally required at such intersections.

After the respective carrier truss structures are fabricated in the shop, they are normally interconnected in pairs to form generally V-shaped assemblies. This is accomplished by initially orienting the planar truss structures in an angular, converging relationship wherein the lower chords thereof are adjacent, followed by interconnection of the lower chords along the common length thereof. In order to provide such additional metal as required at mid span for maximum moment and deflection inertia conditions, a reinforcing member (e.g., a steel girder of desired length and of inverted T-shaped configuration) may be inserted between the lower chords prior to the interconnection step. The spaced apart upper ends of the respective truss structures are then temporarily braced, and the truss assemblies are transported to the erection site. In some instances a metal studded underplate forming a part of the ultimate bridge deck will also be permanently attached to the top of the truss assemblies in the shop and temporarily shored from the bottom chord panel points, ready for field application of concrete after erection.

At the bridging site, the preconstructed, transversely V-shaped assemblies are mounted on prepared bearings, and are interconnected at the adjacent upper chord elements, preferably by welding near panel points. At this point the upper deck or superstructure for the bridge is erected or poured in a manner to composite the upper chord panel points of the respective truss structures to the concrete. In particularly preferred forms, sectionalized, precast bridge sections including lowermost, substantially planar, structural metallic plates having respective concrete layers composited thereto are placed on the completed truss assembly, and are welded together and to the underlying panel point intersections of the upper chord elements. As noted, in those instances where the metal plates are attached to the panel points in the shop, deck formation involves simply temporarily shoring the plate and field pouring the concrete deck. The preferred precast decking structures used in this context are of the type disclosed in pending application for U.S. patent entitled "Bridge Section Composite and Method of Forming Same", Ser. No. 093,395, filed: Nov. 13, 1979, and invented by the present inventor. This application is hereby expressly incorporated by reference into the present specification.

BRIEF DESCRIPTION OF THE DRAWINGS

FIG. 1 is a perspective view illustrating a completed bridge structure in accordance with the invention, shown with a lower truss assembly and a sectionalized, precast decking structure mounted thereon;

FIG. 2 is a perspective view illustrating a single, transversely V-shaped truss assembly in accordance with the invention, comprised of separate, interconnected, generally planar truss structures;

FIG. 3 is a fragmentary plan view of the assembly depicted in FIG. 2;

DESCRIPTION OF THE PREFERRED EMBODIMENTS

Figure 4:
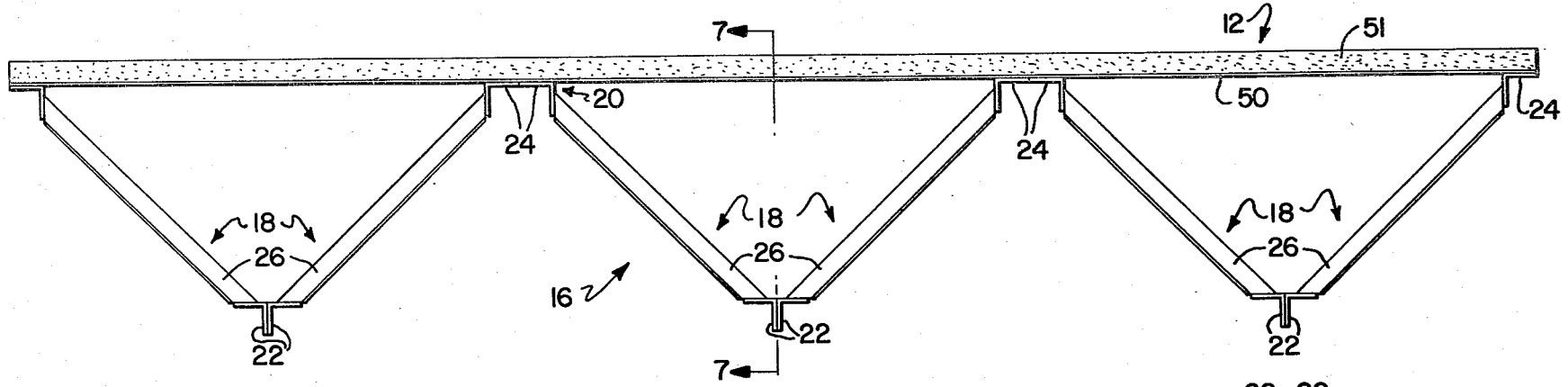
FIG. 4 is an end elevational view of a truss assembly in accordance with the invention, having a decking structure composited thereto.

Turning now to the drawings, a bridge structure 10 in accordance with the invention is illustrated in FIG. 1. The bridge structure 10 broadly includes an elongated, spanning superstructure deck 12 including a concrete layer 14, a metallic truss assembly 16 beneath deck 12 including respective, interconnected carrier truss structures 18, and means generally referred to by the numeral 20 (see FIG. 4) for compositing layer 14 to the truss structures 18. Such mechanical compositing creates a situation wherein the concrete layer 14 serves as a top chord diaphragm for live load induced compression and bending forces and this is important for purposes to be explained hereinafter.

Each earrier truss structure 18 is in the form of an elongated, generally planar construction having an elongated, metallic lower chord 22 and a spaced, parallel, upper chord element 24. In preferred forms of the invention, the chord 22 and element 24 are formed from respective lengths of standard steel angle, such as 8″×8″ steel angle. The element 24 and chord 22 each present (see, e.g., FIG. 2) a depending flange and a laterally extending flange. The depending flanges respectively lie in separate, spaced, substantially parallel planes, and the laterally extending flanges similarly lie in separate, spaced, substantially parallel and horizontal planes. The structure 18 further includes elongated, angularly oriented web members 26 which are operably coupled to chord 22 and element 24 as best seen in FIGS. 2 and 3. It will be observed that each adjacent pair of members 26 converges towards each other, with the adjacent ends of the pair being secured to either the bottom chord 22 or top chord element 24. Also, the upper ends of the members 26 are connected to the depending flange of the element 24, whereas the lower ends of the members are attached to the laterally extending flange of the chord 22. In this fashion a continuous triangulation along the length of each planar truss structure 18 is achieved. Advantageously, the members 26 are cut from a single size of standard steel angle, e.g., 6"×6". In all cases, the steel used for the truss structures is most preferably self-rusting steel such as Cor-Ten steel sold by the U.S. Steel Co.

Figure 13:
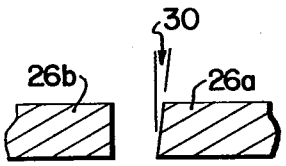
FIG. 13 is a fragmentary sectional view illustrating the fillet formed at the respective ends of the web members as a result of plasma arc cutting thereof.
Figure 15:
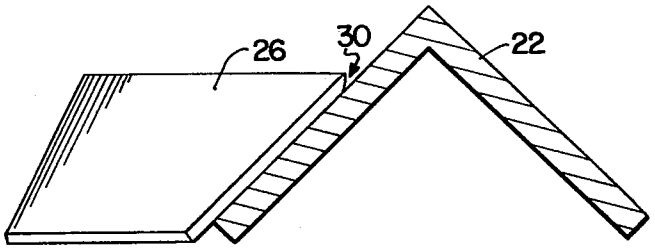
FIG. 15 is a sectional view taken along line 15—15 of FIG. 11.
Figure 11:
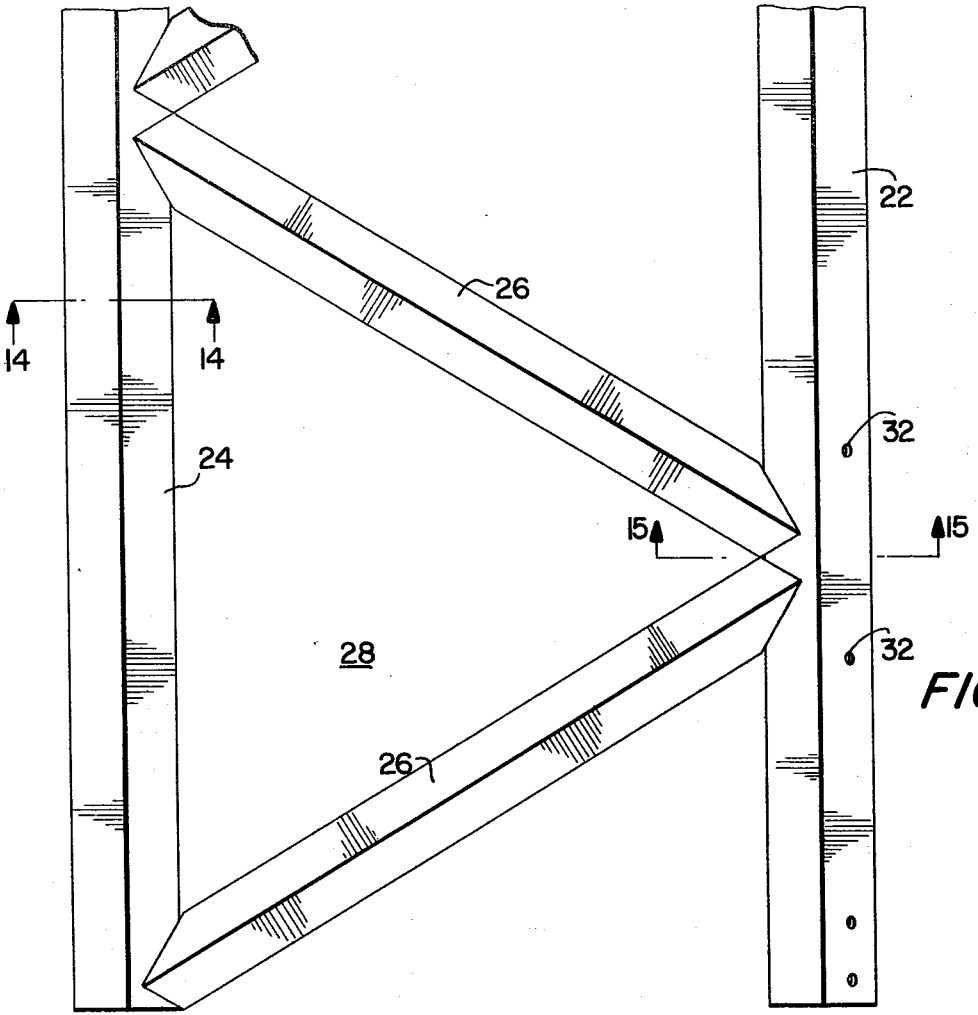
FIG. 11 is a fragmentary plan view illustrating the orientation of the lower chord, upper chord element and web members prior to welding the latter in place.
Figure 12:
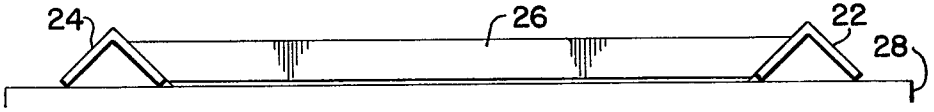
FIG. 12 is an end view of the construction depicted in FIG. 11.

The preferred manufacturing technique for the truss structures 18 is illustrated in FIGS. 11–15. The first step in the fabrication involves setting lower chord angle 22 and upper chord element angle 24 in spaced, parallel relationship to one another on a fabrication bed 28. At this point precut web member angles 26 are angularly positioned between and in engagement with the angles 22, 24 as best seen in FIG. 11. The angles 26 are preferably cut using known plasma arc cutting techniques, wherein the required angular cuts are made in two passes respectively normal to each face of the angle. This not only greatly facilitates low cost, extremely accurate cutting of the members 26, but also as a result of the very accurate computer controlled plasma arc cutting, a fillet area 30 is created at the region of cut along the entire length thereof. As best seen in FIG. 13 wherein two pieces **26*a* and 26*b* are being cut with a plasma arc, a 7 degree fillet area 30 is formed along the length of the cut. When the web members 26 are placed adjacent one of the flanges of the angles 22 or 24, the fillet area 30** and the geometry of the intersection provide a convenient location for weld material such that weld material can be face applied along this naturally filleted seam to the full thickness of the web angle from one side only and thereby fully develop the member without the need for further welding from the other side. This configuration therefore not only allows low cost manual welding but is especially suited to automatic welding equipment.

Following the fabrication of the respective carrier truss structures 18, pairs thereof are oriented to give transversely V-shaped space truss assemblies, such as that depicted in FIG. 2. To this end, the lower chords 22 of the structures 18 are placed in abutting relationship along the length thereof with the depending flanges of the chords 22 being in juxtaposition, and are interconnected. For this purpose it will be observed (see FIG. 11), that the depending flange of each lower chord 22 is apertured as at 32; and the separate chords 22 are interconnected by conventional bolts passed through aligned apertures 32. The V-shaped assembly is completed for transport by applying temporary or permanent, transversely extending cross braces 34 across the spaced upper chord elements 24 (FIG. 2) or by shop applying temporarily shored metallic plates thereacross. In this form, the space trussed assemblies can be safely transported to the bridging site.

Figure 6:
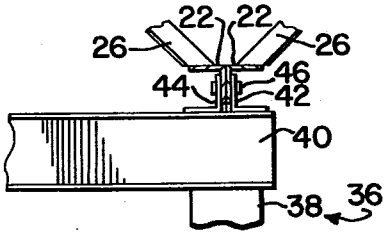
FIG. 6 is a fragmentary view taken along line 6—6 of FIG. 5 which further illustrates the bearing support for the bridge construction.
Figure 5:
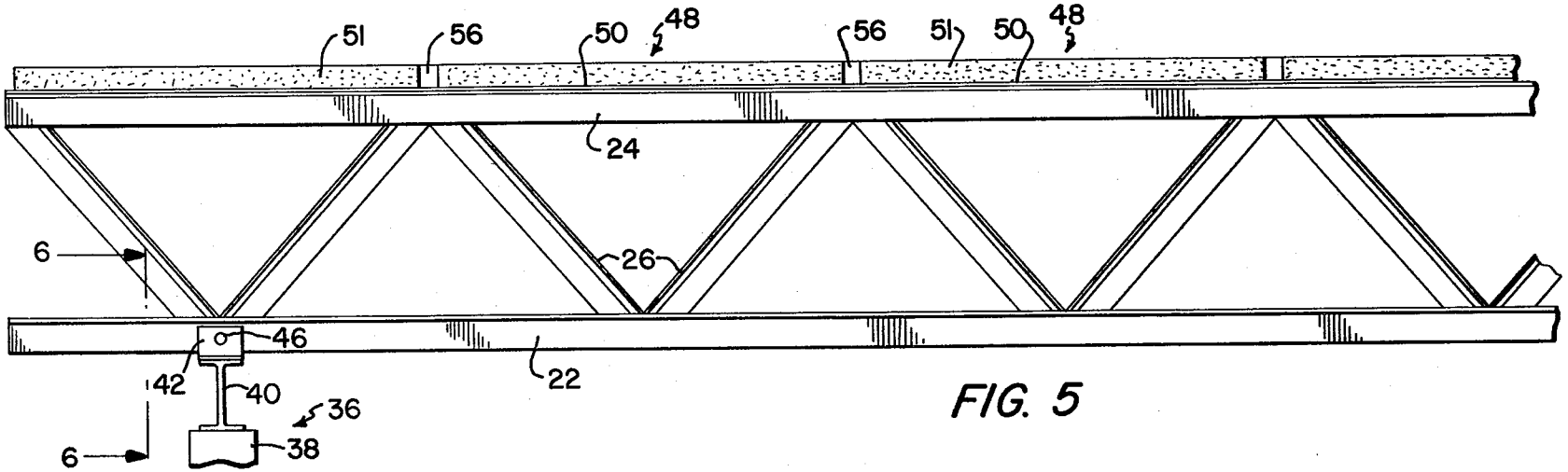
FIG. 5 is a side elevational view of the construction illustrated in FIG. 4.

At the site, the V-shaped truss assemblies are hoisted onto prepared bearing structures 36, which may include cast-in-place concrete piers 38 having transversely extending I beams 40 mounted thereon. As illustrated in FIGS. 5–6, pairs of spaced angles 42, 44 welded to the girders 40 receive the depending, interconnected flanges of the bottom chords 22, and bolt means 46 are employed for coupling the chords 22 to the angles 42, 44. It will further be observed that the bearing connections are made at panel points of the V-shaped truss assembly. It should be noted that if final trussed spans in excess of convenient shipping lengths are required, separate shippable lengths of the final truss are shipped to the site and either bolted or welded together in the field and prior to erection. Also, the downwardly and laterally directed flanges of the chords 22 and web members 26 means that debris collection in the truss structure is minimized.

The next step in the bridge erection procedure involves welding abutting, adjacent top chord elements 24 together at the upper panel points thereof. When this is done, a completed self-supporting truss assembly 16 in accordance with the invention is presented.

Figure 7:
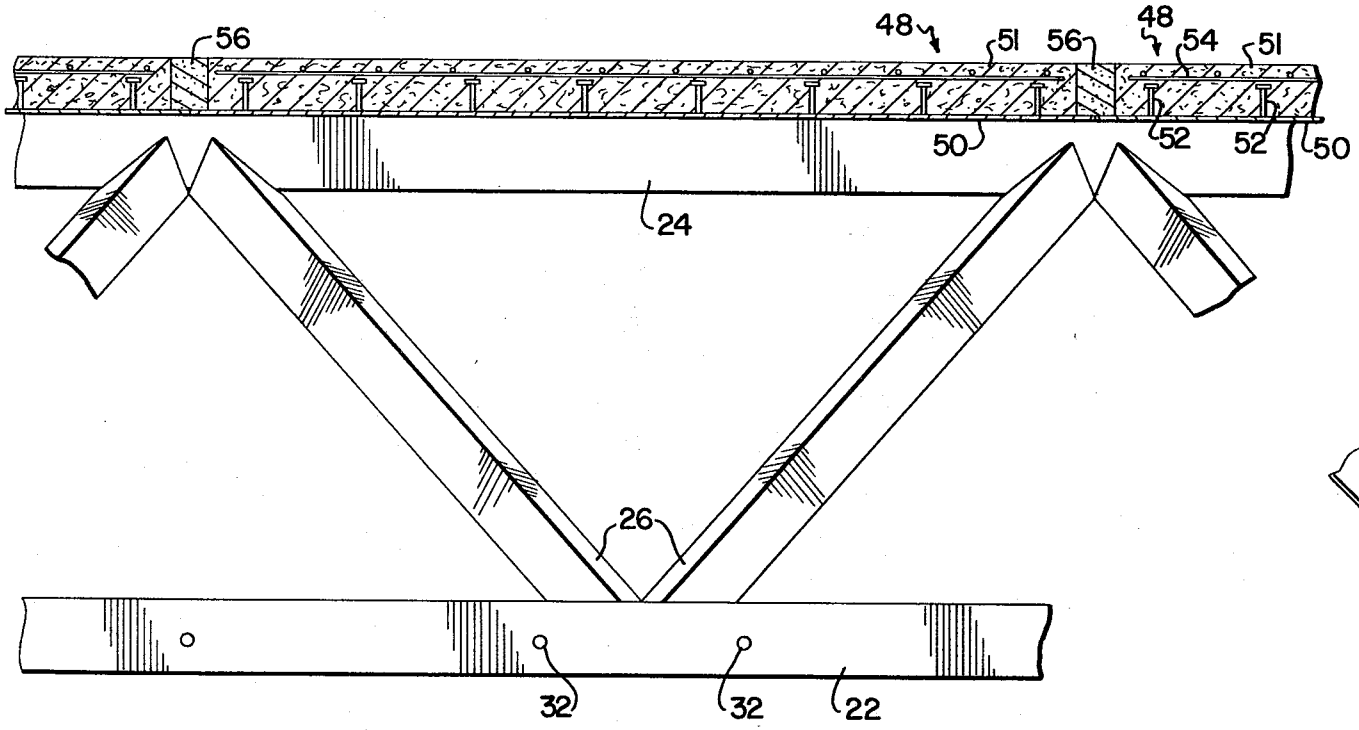
FIG. 7 is a sectional view taken along line 7—7 of FIG. 6.

Superstructure or deck 12 is next coupled to the truss assembly 16 in a manner to composite the concrete layer 14 thereof to the truss structures 18, to the panel points thereof. In the preferred form of the invention, deck 12 is in the form of a series of precast structural sections 48 of the type disclosed in the copending application for U.S. patent incorporated by reference herein; and the details of construction of the sections 48 can be found in this application. Briefly however, each of the sections 48 is of a desired length and width, and includes a substantially planar, structural steel plate 50 of generally the desired length and width of the section, with a corresponding layer of concrete 51 composited thereto. Referring to FIG. 7, it will be seen that each plate 50 has a series of upstanding metallic studs 52 secured to the upper face thereof and embedded within the layer 51. Further, a steel mesh 54 may be embedded within the concrete layer 51. In practice, self-rusting steel plate of at least ¼ inch thickness is used for the plates 50, and the studs 52 serve as a means for compositing the layers 14 to the underlying plates. In another preferred alternative, studded metal deck plate is shop welded across the V-shaped space truss assemblies and temporarily shored to receive a field poured concrete deck.

In the use of the sections 48, they are simply individually hoisted atop the assembly 16 and initially positioned. At this point the plate 50 of the section is welded to the upper chord elements 24 directly above panel point intersections in order to establish a strong, secure mechanical interconnection between the elements 24, plate 50, studs 52, concrete layer 51 and panel point web members. This effectively composites the elements 24 to the concrete layer 51 and relieves the top chord steel elements of principal bending moment stresses induced by the live loads.

As additional sections 48 are positioned atop the assembly 16, the respective plates 50 thereof are stitch welded together and firmly welded or bolted to the elements 24 at panel points, until a decking surface is presented. At this point the joints between the concrete layers 51 are filled with grouting 56, and a field topping of asphalt or concrete (not shown) can be applied over the concrete layers if desired. In the usual construction of bridges in accordance with the invention, railings 57 (see FIG. 1) would also normally be secured to the side margins of the deck 12 near panel points.

Figure 9:
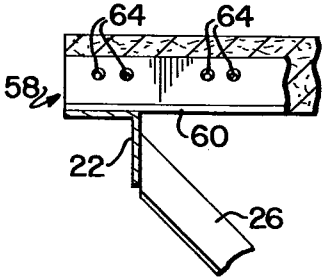
FIG. 9 is a sectional view taken along line 9—9 of FIG. 8.
Figure 8:
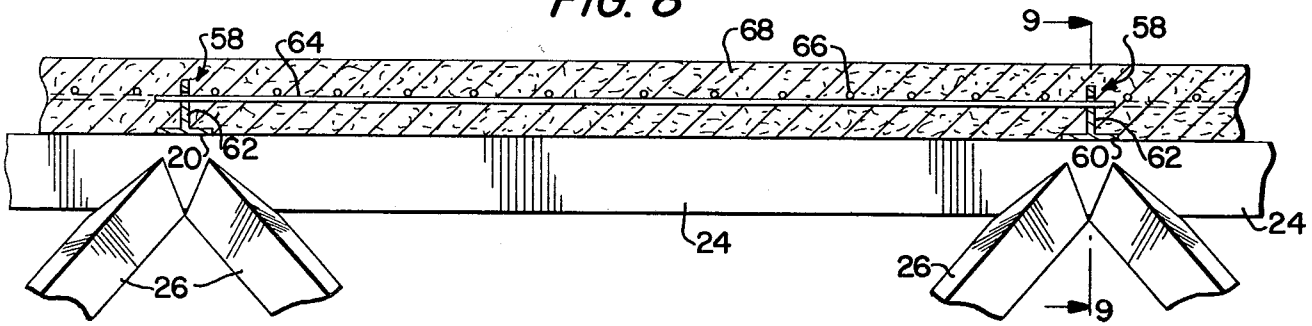
FIG. 8 is a fragmentary view in partial vertical section of a truss assembly in accordance with the invention, having another type of concrete decking structure composited thereto.
Figure 14:
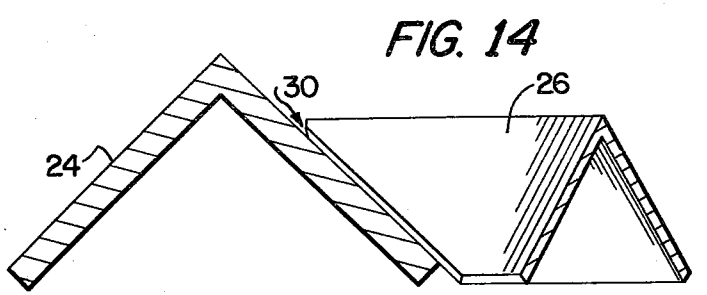
FIG. 14 is a sectional view taken along line 14—14 of FIG. 11.

Although use of the precast sections 48 or shop applied, studded metal plates followed by field pouring of the concrete deck is preferred, the present invention is not so limited. For example, FIGS. 8–9 illustrate another type of decking structure which is field cast. In this instance compositing members 58 of inverted tee-shaped configuration are placed in transversely spanning relationship to the assembly 16 at the upper panel points of the latter, and welded in place. The members 58 include a lower flange 60 in engagement with the horizontally extending upper flanges of the spaced elements 22, along with upstanding, transversely apertured webs 62. Reinforcing bars 64 extend along the length of the assembly 16 and pass through the apertures in the webs 62; moreover, transversely extending reinforcing bars 66 are supported on the bars 64. Temporary forming (not shown) is constructed adjacent the upper end of the assembly 16, and a concrete layer 68 is cast in place over the members 58 and reinforcing bars 64, 66. In this fashion the layer 68 is mechanically composited to the upper chord elements 24 at the panel points thereof.

Figure 10:
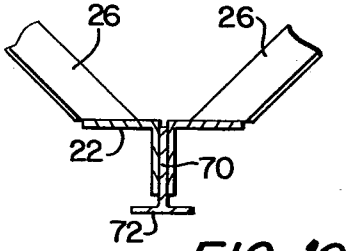
FIG. 10 is a fragmentary view in partial vertical section illustrating the interconnection of a pair of truss structure lower chords, and with a reinforcing member interposed therebetween.

In certain embodiments of the invention, particularly in longer span bridge structures, it is desirable to add additional tension force absorbing metal to the lower chords presented by the transversely V-shaped truss assemblies. This is for the purpose of achieving a net section in excess of that presented by the carrier trusses at the region of maximum live load moment and to limit deflection but preserve the standard framing sizes and shapes of the carrier truss network. In such cases a reinforcing web 70 is advantageously interposed between the depending flanges of the adjacent lower chords 22 for the required length at mid span. Such a flange 70 may be a part of an elongated, integral structural steel member of inverted tee-shaped configuration including a lowermost, horizontally extending flange 72. In practice, the web 70 is placed between the lower chords 22 (FIG. 10) and the three members are interconnected, as by bolts or other typical means of attaching lower chords together.

In a completed bridge structure in accordance with the invention, the lower chords for the truss assembly presented by the respective, interconnected chords 22 (and the flanges 70 when used) serve as a means for absorbing and distributing tensile forces. On the other hand, the top chord for the truss structure is a composite made up of the elements 24 and the concrete layer or layers composited therewith at upper panel points. This top chord serves to absorb and distribute compressive forces experienced by the bridge structure. Hence, the present invention takes maximum advantage of the considerable compressive and inertial strength of a concrete, and in effect renders the concrete layer a structural element, as opposed to merely dead weight to be supported. Additionally, the composite is formed in such a way as to induce no significant bending stresses in the top chord due to the moving, concentrated loads. In fact, after mechanical compositing of the elements 24 to the concrete material at panel points, the elements 24 become, to a large extent, redundant, and the concrete, not the steel, is the primary structural element serving as the top chord for the space trussed structures for purposes of absorbing live load-induced moment and compressive stresses.

As a result of these structural advantages, bridges of the invention have very low dead load to live load ratios, ideally efficient amounts of tensile and web metal, and moreover the depth-to-span ratios thereof are much lower (up to about 1:27) than is common with conventional steel truss bridges (on the order of 1:10).

Use of Warren Type triangulation for constructing the space truss structure allows a wide range for stress reversals from tension to compression within the structure without specific analysis or restriction on where these stress reversals might take place. This also creates a situation wherein the truss assembly can be bottom-supported on a pier or other bearing structure at any given panel point along the length thereof. It should also be noted that the combination of elements in the space truss and composite configuration with diaphragm decking eliminates not only the need for bracing between trusses (because of the very high resultant polar moment of inertial resistance to differential torsion) but allow the use of 0.85 K factors when computing unsupported web lengths in compression.

Finally, from a structural standpoint, it will be appreciated that the bridge structures of the invention have a very high multiplicity of force-transmitting elements in the truss assemblies in order to evenly distribute tensile and compressive loads without undue stress concentrations. For example, in the embodiment illustrated in FIG. 10, the lower chord depicted is composed of three virtually independent members, two angles 22 and the inverted tee-shaped member. This, in addition to the connected webs 26, presents a situation where multiple alternate paths of stress distribution are defined at the lower chord and by the four member web intersections at each interior panel point. The feature of structural redundancy is very important in high water bridge designs, for example, where the bottom of the bridge is held about two feet above the fifty or one hundred year high water elevation. In the case of high water, debris and the like can crash into the bridge structure, and particularly the underlying truss assembly. For this reason known truss systems would not be sufficiently braced or redundant to be used for this application without danger of critical failure due to impact. Furthermore, the long term stress reversals due to live loading can result in failure of given welds. Here again high levels of alternate stress paths are quite desirable.

Use of steel angles as the structural elements of the truss structures of the present invention represents, in and of itself, a significant breakthrough and moreover gives a large number of advantages from the standpoints of materials and fabrication costs, structural stability and field maintenance. In order to fully understand and appreciate these advantages, a detailed discussion thereof is believed in order.

First of all, it should be understood that the design and construction of extremely strong truss structures is not per se difficult. The real problem arises when costs are taken into account, and it is at this point that traditional truss structures, normally using large quantities of special order steel and skilled on-site labor, become impractical.

In order to be cost effective, truss structures should be constructed using standard rolled shapes of steel, and in a manner to avoid use of adjacent pairs of members to achieve symmetry (so as to lower materials costs and also halve cutting and welding operations). This is particularly critical if self-rusting steel is to be used. Further, the shape of steel chosen must allow for high working levels of stress in compression.

Standard rolled steel shapes include wide flanges or I beams, channels, angles, rods, bars and plates; tubes and other specialty shapes are not standard. Given the practical restraint of employing standard shapes, and of the need for symmetry for load-bearing purposes, use of angles would at first blush appear to be wholly impractical. That is to say, angles are not symmetrical shapes (except along the seldom used Z-axis thereof), and are therefore difficult to load evenly. Also, because of the position of the two axes of each leg, it is difficult to connect angles symmetrically with intersecting, or close to intersecting, gauge lines. Finally, it is normally troublesome to cut and weld angles to other structural members, and as a consequence extensive gusseting is customarily employed.

These and other problems are solved in the present invention however, wherein standard steel angles are plasma arc cut and singly placed relative to each other to achieve a symmetrical load-bearing space frame configuration with a complete elimination of gusset plates. Further, the steep angle cuts on the web members creates a very long, filleted weld area which allows full penetration welding from but a single side and over a substantial length to yield fully developed, force-transmitting connections at the panel points. In short, the most unlikely candidate among the standard steel shapes has been used to give a structurally superior, low cost and mass producible truss.

In many prior truss structures, it is a common practice to construct the upper and lower chords, and web members, using adjacent pairs of steel members for the structural elements. This is done to ensure that loads are symmetrically distributed without substantial bending moments being introduced at the intersections of the members. However, as noted above, this need is completely obviated in the present invention which provides single steel angle sections for all members, welded together and oriented such that these gravity axes perform mutual intersections, planarly, spatially, symmetrically (both as individual frames and in final composite configuration) for the full range of spans from 70 to 200 feet. Of course, multiple sections of steel may be employed to form a single chord or chord element, but in this case they are axially aligned and interconnected; as used herein in reference to the single section construction of the truss assembly, what is referred to is the fact that the use of side-by-side, closely spaced pairs of steel members is avoided.

Having thus described the invention, what is claimed as new and desired to be secured by Letters Patent is:

1. In a bridge structure:

an elongated, spanning deck including a reinforced concrete layer;

at least four individual carrier truss structures, each including an elongated lower chord element formed of metallic angle and presenting a pair of elongated, generally planar, interconnected flanges;

a plurality of individual, upwardly extending metallic web members;

means including first weld joints joining said web members to said lower chord element at spaced locations along the element, respective adjacent web members converging and meeting at points above said lower chord element; and means including second weld joints at said points coupling respective pairs of converged web members and defining a plurality of spaced apart panel points along the length of the carrier truss structure;

means operably interconnecting respective pairs of said truss structures to present at least two generally V-shaped in cross-section truss assemblies each having the lower chord elements of two truss structures in juxtaposed relationship, and the web members joined to each lower chord element extending obliquely upwardly therefrom, said interconnecting means including bolt means coupling each pair of juxtaposed lower chord elements at spaced locations therealong to form a composite lower chord for each truss assembly, said V-shaped truss assemblies being oriented beneath said deck in side-by-side relationship with the composite lower chord of each assembly extending along the direction of span of the bridge structure and with said web members extending upwardly toward said deck;

means compositing said deck and truss assemblies, including a plurality of metallic force-transmitting elements embedded in said concrete layer and having mechanical interlock structure above the lower surface of said concrete and embedded therein; and means operably coupling said force-transmitting elements and web members therebeneath, including force-transmitting third weld joints at the regions of at least certain of said panel points.

2. The bridge structure as set forth in claim 1, each of said carrier truss structures further including an elongated, metallic upper chord element, said respective pairs of converged web members being welded to said upper chord element by said second weld joints.

3. The bridge structure as set forth in claim 2, said upper chord elements being formed of metallic angle presenting a pair of elongated, generally planar, interconnected flanges.

4. The bridge structure as set forth in claim 1, including an elongated metallic reinforcing member located between said juxtaposed pairs of lower chord elements, and means including said bolt means interconnecting the reinforcing member and the adjacent lower chord elements.

5. The bridge structure as set forth in claim 1, said force-transmitting elements comprising upright metallic studs.

6. The bridge structure as set forth in claim 5, said coupling means comprising a substantially flat, metallic plate interposed between the underside of said concrete and said truss assemblies, said plate being welded by said third weld joints at the region of at least certain of said panel points, said studs being welded by fourth weld joints to the face of said plate remote from said truss assemblies.

7. The bridge structure as set forth in claim 6, the only force-transmitting connection between said plate and the underlying truss assemblies being said third weld joints at said panel point regions.

8. The bridge structure as set forth in claim 1, said force-transmitting elements comprising a plurality of elongated, spaced, metallic components, said components being welded by said third weld joints to panel points.

9. The bridge structure as set forth in claim 8, said mechanical interlock structure comprising elongated reinforcing bars extending between and operatively connected to said spaced components.

10. The bridge structure as set forth in claim 8, said components being of inverted T-shaped configuration.

11. The bridge structure as set forth in claim 1, said web members being formed of metallic angle.

12. The bridge structure as set forth in claim 1, there being three of said V-shaped truss assemblies.

13. The bridge structure as set forth in claim 1, including crossbracing means interconnecting the truss structures of each assembly.

* * * * *